US012214915B2

(12) United States Patent
Schulz

(10) Patent No.: US 12,214,915 B2
(45) Date of Patent: Feb. 4, 2025

(54) STRAPPING DEVICE HAVING A DEVICE FOR ROTATING A PACKAGE

(71) Applicant: Signode Industrial Group LLC, Tampa, FL (US)

(72) Inventor: Friedhelm Schulz, Wipperfürth (DE)

(73) Assignee: Signode Industrial Group LLC, Tampa, FL (US)

( * ) Notice: Subject to any disclaimer, the term of this patent is extended or adjusted under 35 U.S.C. 154(b) by 62 days.

(21) Appl. No.: 17/906,766

(22) PCT Filed: Mar. 4, 2021

(86) PCT No.: PCT/US2021/020853
§ 371 (c)(1),
(2) Date: Sep. 20, 2022

(87) PCT Pub. No.: WO2021/194715
PCT Pub. Date: Sep. 30, 2021

(65) Prior Publication Data

US 2023/0356867 A1 Nov. 9, 2023

(30) Foreign Application Priority Data

Mar. 23, 2020 (DE) ..... 10 2020 107 945.1

(51) Int. Cl.
*B65B 13/18* (2006.01)
*B65B 13/06* (2006.01)
*B65B 13/20* (2006.01)

(52) U.S. Cl.
CPC ..... *B65B 13/187* (2013.01); *B65B 13/06* (2013.01); *B65B 13/20* (2013.01)

(58) Field of Classification Search
CPC ..... B65B 13/06; B65B 13/20; B65B 13/187
See application file for complete search history.

(56) References Cited

U.S. PATENT DOCUMENTS 2,835,194 A * 5/1958 Crosby ..... B65B 27/06 100/14
3,174,631 A * 3/1965 Swihart ..... B65B 13/02 100/14

(Continued)

FOREIGN PATENT DOCUMENTS

EP 2796376 B1 11/2016
JP S6013888 B2 4/1985

(Continued)

OTHER PUBLICATIONS

"International Search Report and Written Opinion", corresponding PCT Application No. PCT/US2021/020853, Jun. 22, 2021.

(Continued)

*Primary Examiner* — Thomas M Wittenschlaeger
*Assistant Examiner* — David G Shutty
(74) *Attorney, Agent, or Firm* — Neal, Gerber & Eisenberg LLP

(57) ABSTRACT

A strapping device for strapping packages, having a packing table on which the package passes through the strapping device along a movement path, having a strapping frame, having a rotation device in the packing table, having a strapping channel which is formed by the strapping frame, and having closure flaps which close a channel opening of the channel member which is arranged in the packing table.

19 Claims, 17 Drawing Sheets

(56) References Cited

U.S. PATENT DOCUMENTS 3,179,037 A * 4/1965 Cranston, Jr. ..... B65B 13/06 100/31
3,182,586 A * 5/1965 Armington ..... B65B 13/186 100/238
3,613,557 A * 10/1971 Coleman ..... B65B 13/06 100/26
3,759,169 A 9/1973 Goodley
3,901,138 A 8/1975 Bilt
3,949,662 A * 4/1976 Woomer ..... B65B 13/06 100/32
3,955,491 A * 5/1976 McMahon ..... B65B 27/06 53/529
4,058,270 A * 11/1977 Simmons ..... B21C 47/18 242/561
4,312,266 A * 1/1982 Pasic ..... B65B 13/183 100/14
5,111,634 A * 5/1992 Rauch ..... B65B 27/086 53/589
5,355,786 A * 10/1994 Tipton ..... B65B 13/06 53/589
5,400,706 A * 3/1995 Tipton ..... B65B 13/06 53/589
2011/0219960 A1 9/2011 Jowett et al.

FOREIGN PATENT DOCUMENTS

JP H0524004 B2 4/1993
KR 20130053074 A * 5/2013 ..... B65B 13/14

OTHER PUBLICATIONS

"Office Action", from corresponding German Patent Application No. 10 2020 107 945.1, with English translation, Nov. 10, 2020.

* cited by examiner

STRAPPING DEVICE HAVING A DEVICE FOR ROTATING A PACKAGE

PRIORITY

This application is a national stage application of PCT/US2021/020853, filed on Mar. 4, 2021, which claims priority to and the benefit of German Patent Application No. 10 2020 107 945.1, filed on Mar. 23, 2020, the entire contents of which are incorporated herein by reference.

BACKGROUND

The present disclosure relates to a strapping device for strapping packages.

Generic strapping machines are adequately known from the prior art. They serve to strap packages or to form bundles of individual goods. Large-framed strapping machines to which the present disclosure primarily relates, as a result of the strapping of the packages, also secure the pallet to a goods carrier.

From the prior art which cannot be substantiated with written documentation, there is known a strapping device in which the strapping channel has a channel member which is located in the packing table itself. It is arranged in an intermediate space between rollers which are located in the packing table and on which the package is moved through the device. To this end, the rotation axis of the rollers is arranged transversely relative to the passage direction of the package through the device.

In order to carry out a so-called cross-strapping, there is a lifting and rotation device. This comprises a frame which is arranged in the packing table, and which is located in the strapping region. In order to rotate a package through 90° with respect to its strapping position and to enable a cross-strapping, the frame is raised after a first strapping operation with the package arranged thereon, rotated through 90° and lowered. A second strapping operation can be carried out afterwards. In order to then convey the package out of the strapping device with the correct orientation, a lifting, a rotation through 90° and a lowering are carried out again.

The channel member which rests in the package is interrupted in intersection regions with the frame of the rotation device. The frame itself is arranged in its rest position either below the channel base or contains a channel-like cut-out so that the strapping band with the frame in the rest position can be guided along below the package in the packing table without any impediments.

U.S. Pat. No. 5,400,706 discloses a device which has in place of a channel member which is located in the package a bayonet which can be introduced above the packing table. This bayonet contains the channel member of the strapping channel, which is close to the packing table and enables, for example, a strapping in an intermediate runner space of a pallet.

U.S. Pat. No. 5,400,706 discloses a rotation device in the form of a rotary plate which is part of the packing table, and which can be rotated through 90° without a previous lifting operation with the package located thereon in order to enable a cross-strapping.

The device of the prior art which is not known from written documentation has the significant disadvantage that, as a result of the raising and lowering of the frame of the rotation device, a considerable amount of time is required for a cross-strapping operation.

SUMMARY

The present disclosure relates to a strapping device for strapping packages, having a packing table on which the package passes through the strapping device along a movement path, having a strapping frame which is arranged transversely relative to the movement path of the package on the packing table and which defines a strapping region on the packing table which the package passes during the movement along the movement path, having a rotation device in the packing table, by way of which the package can be rotated through 90° between a first strapping position and a second strapping position, having a strapping channel which is formed by the strapping frame and which has at least one channel member which is arranged in the packing table and which extends between a first and a second packing table edge, having closure caps which close a channel opening of the channel member which is arranged in the packing table, which channel opening faces the frame interior, and which can be opened in order to pull the strapping out of the strapping channel.

An advantage of the present disclosure is to provide a strapping device which is provided with a strapping channel in the packing table and in which the operation of a cross-strapping can be significantly accelerated.

One advantage of the present disclosure is achieved by a rotation device which is arranged in the packing table and that rotates the package only by way of a rotational movement in the arrangement plane thereof.

Since various embodiments of the device according to the present disclosure dispenses with raising and lowering and carries out the rotation device only as a result of a rotational movement in its arrangement plane, that is to say, in the packing table plane, in order to rotate the package which is located on the packing device through approximately 90° for a cross-strapping operation, the time required for raising and lowering the package is dispensed with. In this manner, a cross-strapping can be significantly accelerated compared with the prior art which cannot be substantiated with written documentation.

There is therefore provision for the rotation device to be a rotatably supported circular region of the packing table.

A particularly preferred embodiment is characterized in that the at least one channel member which is arranged in the packing table is formed by a first member position which is fixed in position and which extends between the first packing table edge and the rotation device and which forms an outlet in the transition region to the rotation device, in that the at least one channel member which is arranged in the packing table is formed by a second member portion which is fixed in position and which extends from the transition region to the rotation device up to the second packing table edge and which forms an outlet in the transition region to the rotation device, in that the at least one channel member which is arranged in the packing table is formed by at least a third member portion which is connected to the rotation device and which extends in the first strapping position of the rotation device from the outlet of the first member portion to the outlet of the second member portion, in that the third member portion which is connected to the rotation device forms at the ends thereof close to the outlets of the first and second member portions an inlet for the strapping.

According to various embodiments of the present disclosure, the channel member which is arranged in the packing table is formed in at least three parts. In the fixed, non-movable region of the packing table, that is to say, in the region outside the rotation device, there is a member portion which is fixed in position in each case. A third member portion is part of the rotation device and is arranged in the packing table region formed by the rotation device. It is located between the member portions which are fixed in position and forms together with them the channel portion in a first position of the rotation device.

As a result of the channel member which is arranged in the packing table being divided into three pieces, a rotation device with a large contact surface for a package can be produced and also extends beyond the channel member arranged in the packing table. Since the third channel member is connected to the rotation device and changes its position during a movement of the rotation device, the packing-table-side channel member of the strapping channel does not impede a package rotation for a cross-strapping operation.

An embodiment is particularly preferred in which, in order to form the channel member, which is arranged in the packing table, a fourth member portion which is connected to the rotation device is provided. This can be orientated alternatively to the third member portion with the first and second member portions of the packing table which are fixed in position. In an ideal case, there is provision for the third member portion of the rotation device which is connected to the rotation device to be orientated in a first rotation device position with the member portions of the packing table which are fixed in position and for the fourth member portion of the rotation device which is connected to the rotation device to be orientated in a second position of the rotation device which is preferably rotated through 90° with the member portions which are fixed in position.

As a result of the arrangement of another fourth member portion in the packing table, the channel member which is connected to the packing table can be formed in two possible positions of the rotation device so that a strapping in both rotation device positions and consequently a cross-strapping of a package which is located on the rotation device is possible.

There is provision for the third and fourth member portions to intersect in the region of the rotation device. The respective inlets of the third and fourth member portions are located in a common plane which corresponds to the plane of the outlets of the first and second member portions. It is thus ensured that the strapping band with each strapping operation can move from the member portions which are fixed in position to the rotationally movable member portion which is orientated in each case with the member portions which are fixed in position and a continuous channel member which is connected to the packing table is formed.

In order to prevent a collision of the intersecting third and fourth member portions, there is provision for the fourth member portion to rise from one of the inlets thereof into a plane above the third member portion in order to span the third member portion in the intersection region and then to descend as far as the other of the inlets thereof.

The fourth member portion is thus guided virtually in the manner of a bridge over the third member portion, which enables collision-free band guiding both in the third member portion and in the fourth member portion.

In order to ensure that a strapping band is pulled out of the channel member which is located in the packing table, in particular in the intersection region of the third and fourth member portions, there is provision for the fourth member portion to be interrupted in the intersection region with the third member portion so that if necessary the strapping can be pulled out of the third member portion in the direction toward the frame interior.

The end regions of the interrupted third member portion which are associated with each other may be expanded in a funnel-like manner in order to ensure the removal and in particular the reintroduction of the strapping band out of/into the third member portion.

BRIEF DESCRIPTION OF THE SEVERAL VIEWS OF THE DRAWINGS

Other features of the present disclosure and the advantages thereof are set out in the following description of an embodiment. In the drawings.

DETAILED DESCRIPTION

Figure 1:
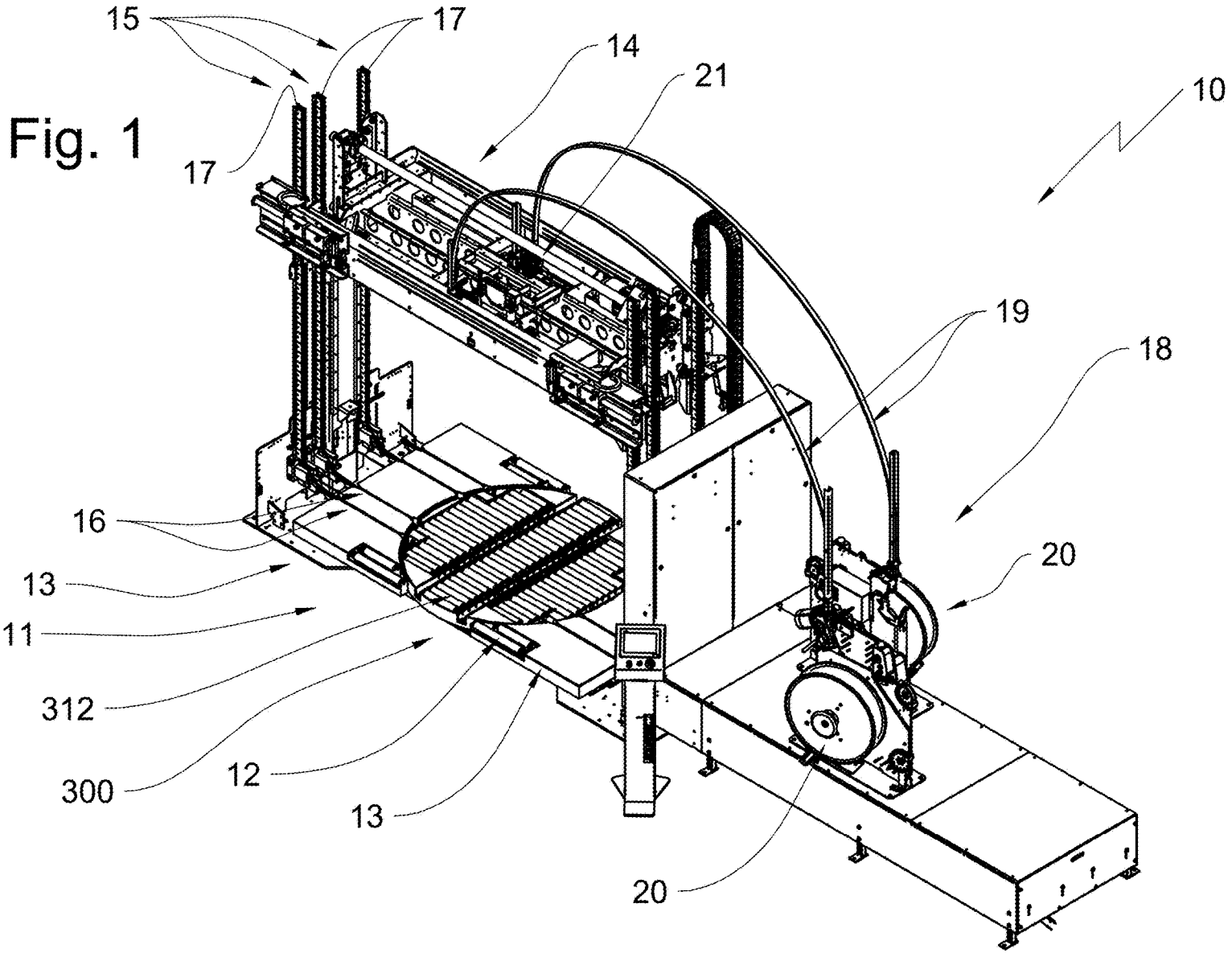
FIG. 1 is a perspective overview of the strapping device according to one embodiment of the present disclosure with a rotation device in a first position.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

In the Figures, a strapping device for strapping packages is particularly designated 10.

Figure 2:
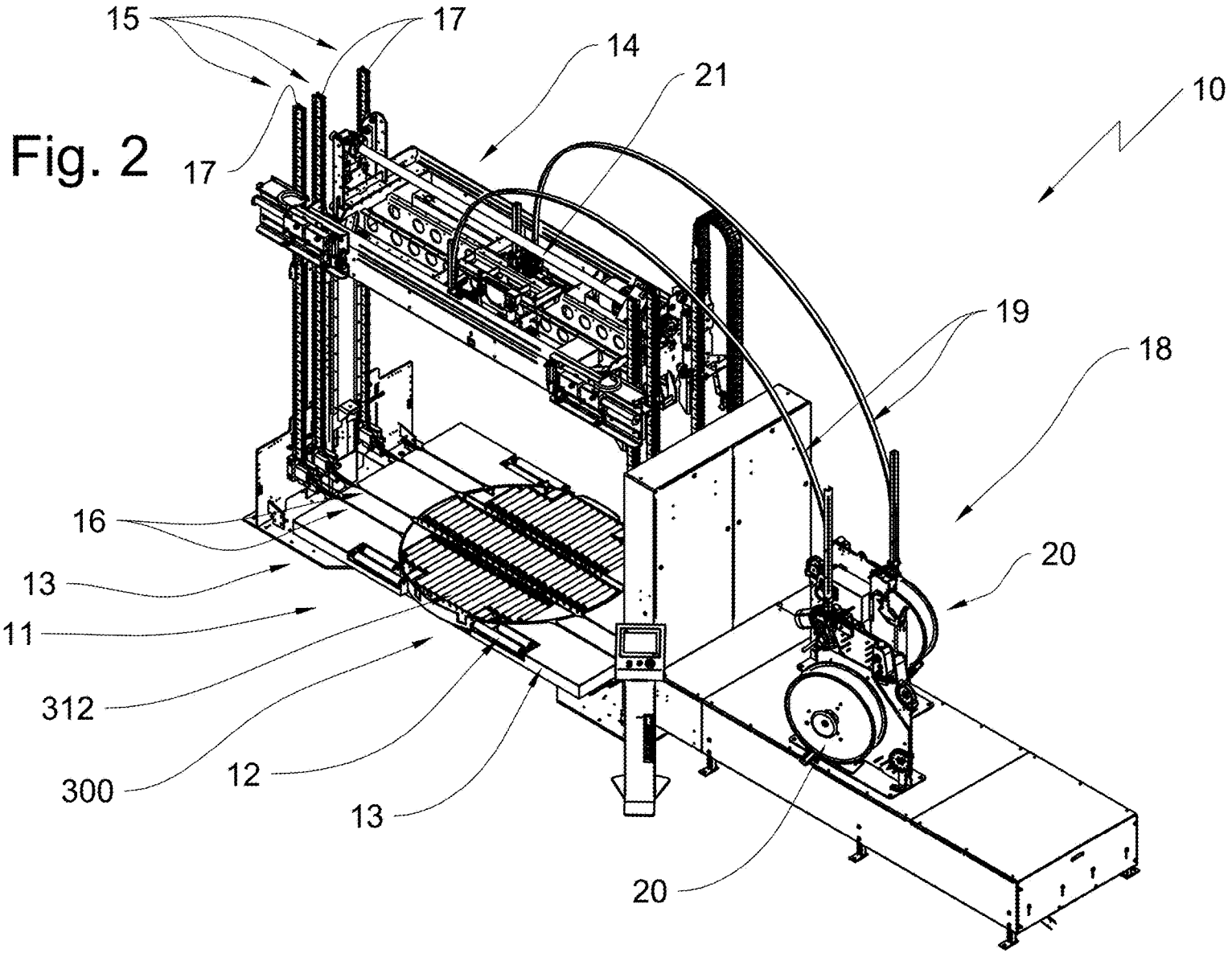
FIG. 2 shows the strapping device according to FIG. 1 with the rotation device in the second position.

In FIGS. 1 and 2, the strapping device 10 is illustrated in its entirety. It comprises a packing table 11, which is provided with rollers or drums 12 on which a package which is not illustrated is moved through the strapping device 10.

In FIGS. 1 and 2, the packing table 11 has a central rotation device 300 which as part of the packing table 11 is also provided with rollers or drums 12/312 and is located between two non-movable packing table portions 13. In other words, the rotation device 300 is a rotatable portion 300 of the packing table 11 between the two spaced-apart stationary portions 13 of the packing table 11. The non-movable packing table portions 13 are illustrated in a simplified manner for the sake of greater clarity. In a preferred embodiment, they are provided over the entire surface extent thereof with rollers or drums 12. However, this is only indicated here for greater clarity by illustrating a few rollers or drums 12.

The strapping device 10 has a pressing plate 14 which can be moved up and down as a result of vertical posts which are arranged at the side of the packing table 11 and which are not illustrated for reasons of clarity in order to compress packages which are intended to be strapped, such as, for example, corrugated cardboard, during the strapping operation.

The strapping device 10 further has a strapping frame which is formed by the pressing plate 14, the vertical post which is not illustrated and the packing table 11 and at least one, but in the embodiment three strapping channels 15. Each strapping channel 15 extends along the pressing plate 14, the vertical posts and the packing table 11 and consequently has a horizontal channel member 16, which is arranged in each case in the pressing plate 14 and in the packing table 11, and a vertically orientated channel member 17 which is arranged on the vertical posts which are not illustrated.

A band feeding device 18 is arranged at the side of the strapping frame and has in this case two supply bars 19 via which a strapping band B which is stored in each case on a reel 20 is supplied to an insertion and closure device 21 in the pressing plate 14. Each insertion and closure device 21 pushes the strapping band into the strapping channel 15 so that it is returned along the strapping frame around the package, which is not illustrated, and which is located below the pressing plate 14 to the insertion and closure device 21.

When the strapping band B is pulled back, the strapping band B is pulled out of the channel members 16/17 and tensioned around the package which is not illustrated.

The strapping device 10 which is illustrated in FIGS. 1 and 2 may as a result of the rotation device 300 carry out a so-called cross-strapping. To this end, the package with the rotation device 300 being orientated according to FIG. 1 with roller axes arranged transversely relative to the passage movement of the package is guided into a strapping region below the pressing plate 14. Subsequently, a first strapping is carried out. Then, the rotation device is moved through 90° into the position according to FIG. 2. The axes of the rollers 312 are now orientated parallel with the passage direction of the package through the strapping device 10. There now takes place a second strapping operation which is carried out in a manner offset through 90° with respect to the first strapping operation. Subsequently, in a manner not illustrated in greater detail, the rotation device 300 is moved back through 90° so that it is located in the starting position according to FIG. 1. Subsequently, the package leaves the strapping plane and the strapping device 10.

Figure 3:
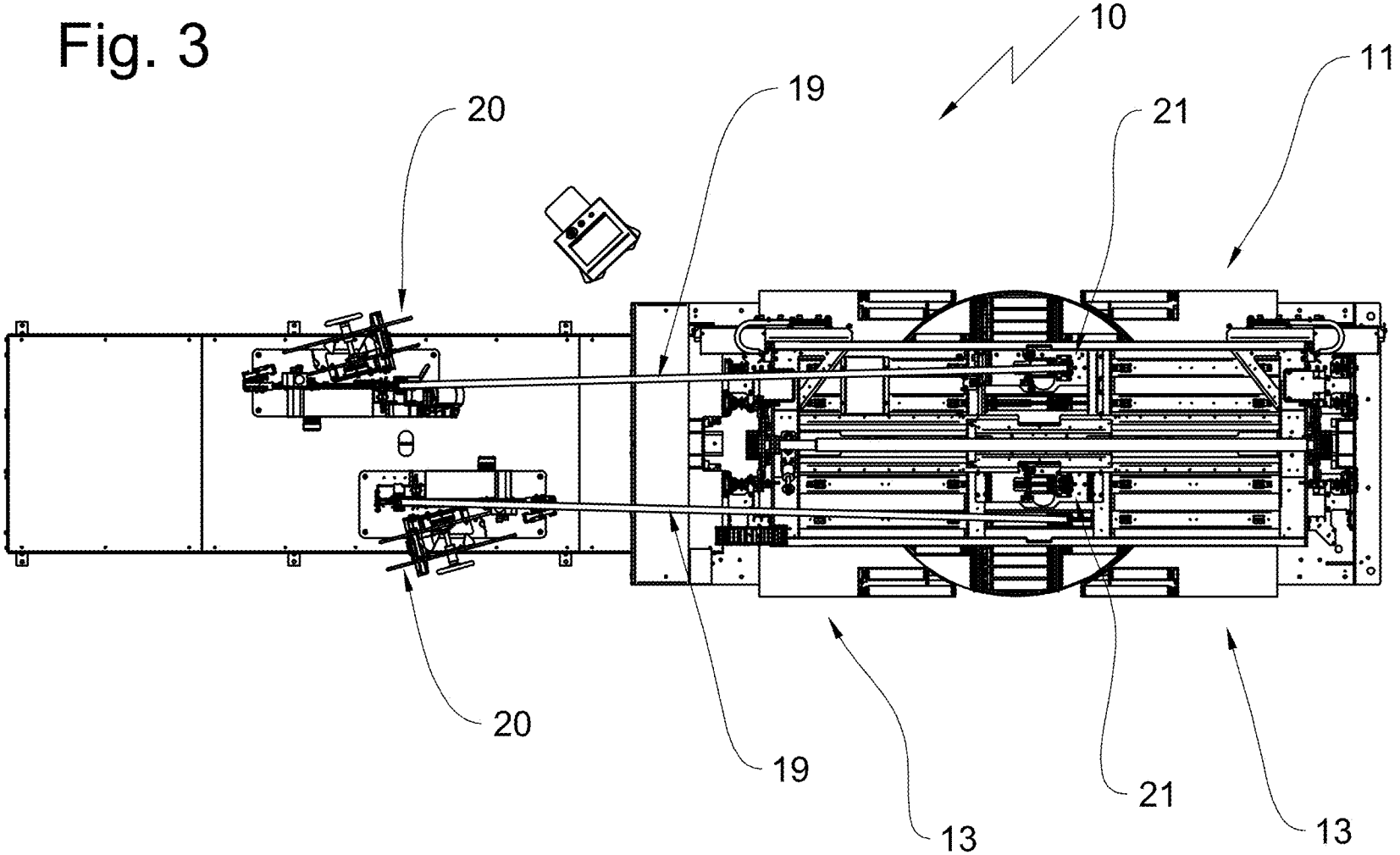
FIG. 3 is a view of the strapping device according to FIG. 1 from above.
Figure 4:
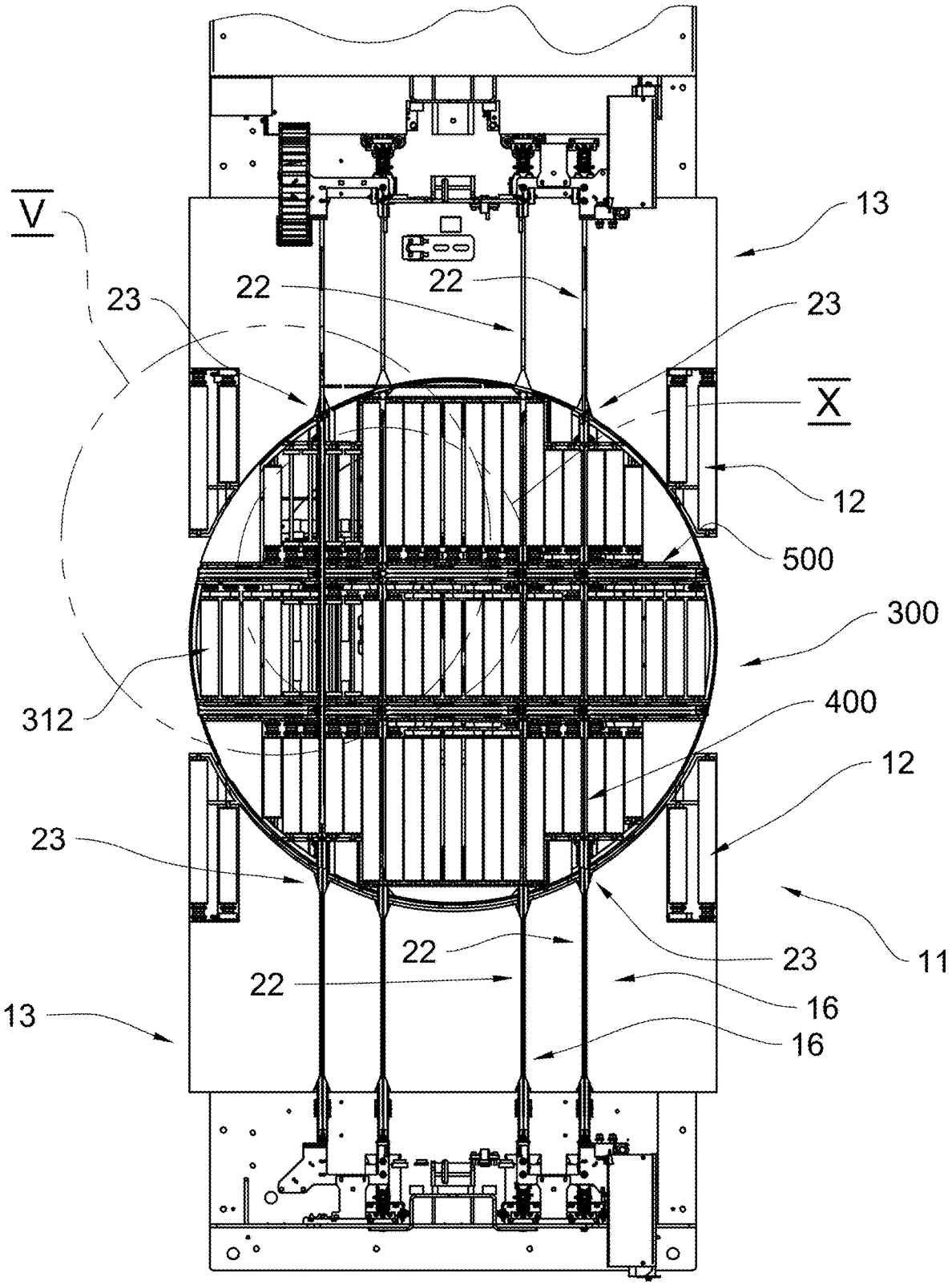
FIG. 4 is an enlarged cut-out of the plan view according to FIG. 3 of the packing table.

FIG. 3 shows the strapping device 10 according to FIGS. 1 and 2 as a view from above. FIG. 4 shows a plan view of the packing table 11 with all the components of the pressing plate 14 located above the packing table 11 being omitted. A significant advantage of the present disclosure is the rotation device 300 which is illustrated in FIGS. 1 to 4, and which is described below in greater detail. Although the strapping device 10 is one which—as already mentioned above—has a horizontal channel member 16 in the packing table plane, the rotation device 300 is moved only in the arrangement plane thereof in the packing table 11 about the rotation axis thereof. It consequently does not leave the packing table plane.

After the general introduction into the strapping device 10 according to the present disclosure with reference to FIGS. 1 to 3, the structure of the packing table and the rotation device will now be illustrated with reference to FIGS. 4 to 17.

FIG. 4 is a plan view of the packing table 11 of the strapping device 10. This table is divided into a right side and a left side packing table portion 13 which is non-movable in each case, and which is provided with rollers 12, of which only some are shown in FIG. 4 in order to ensure greater clarity.

Between the non-movable packing table portions 13 is the rotation device 300 according to the present disclosure which can be rotated in the packing table plane through at least 90° in the clockwise direction and in the counterclockwise direction.

There is/are arranged in the packing table 11, in the embodiment four, but according to the present disclosure at least one, horizontal channel member(s) 16, along which the strapping band B is guided through the first non-movable packing table portion 13 into the rotation device 300 and onward to the second non-movable packing table portion 13 in the strapping frame.

Each channel member 16 in the packing table 11 is sub-divided into two member portions 22 which are fixed in position, and which are each arranged in one of the non-movable packing table portions 13, and member portions 400 and 500 which are connected to the rotation device. The member portions 400 which are connected to the rotation device are arranged parallel with the roller/drum axis of the rollers 312 of the rotation device 300, the member portions 500 are arranged transversely relative to the roller/drum axis of the rollers 312 of the rotation device 300. The member portions 400 or 500 which are connected to the rotation device can be orientated alternately and in accordance with the rotation position of the rotation device 300 between the positionally fixed member portion 22 of the non-movable packing table portions 13. Consequently, in the respective rotation position of the rotation device 300, a continuous channel member 16 is provided in the packing table 11.

Figure 13:
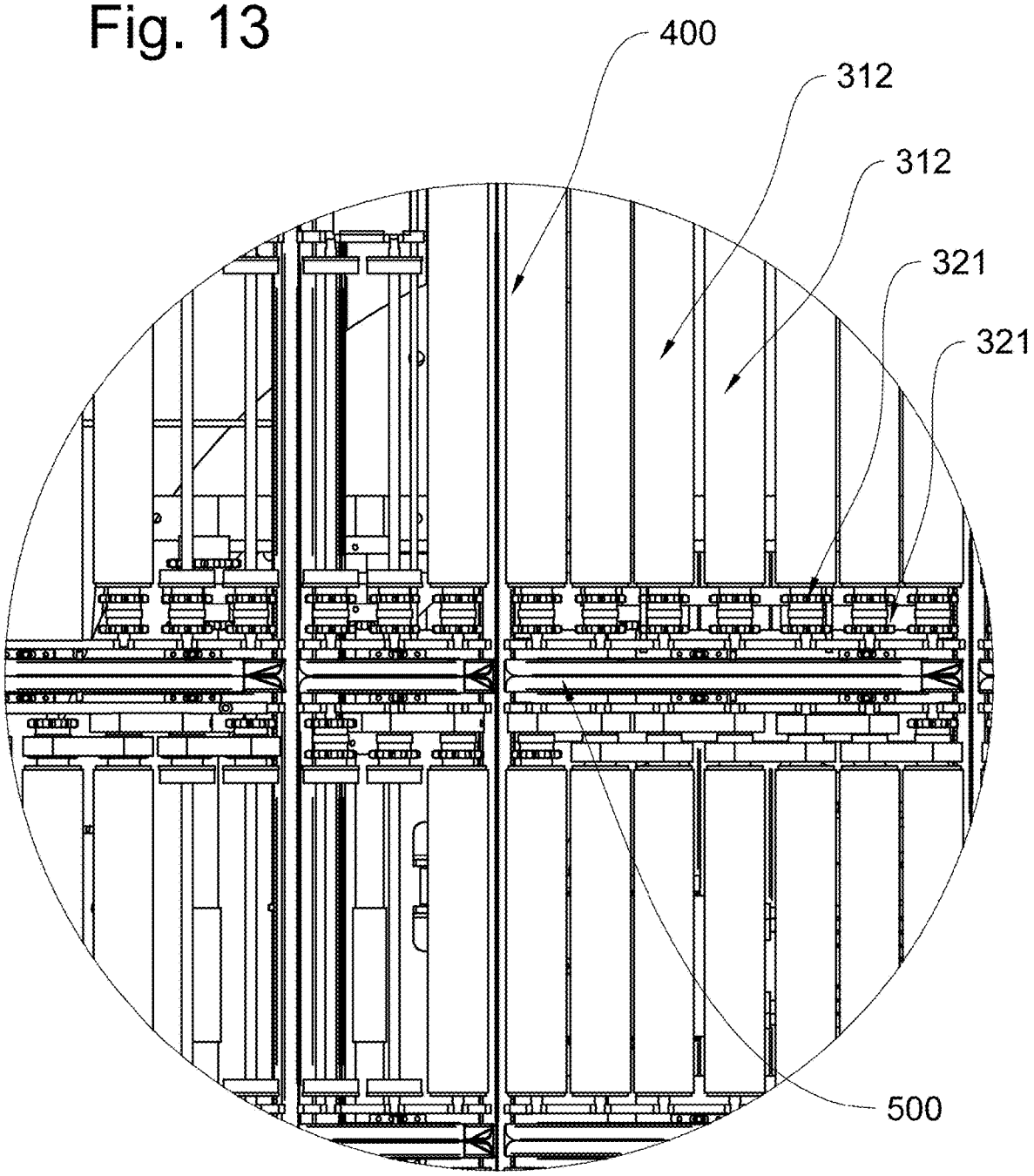
FIG. 13 is an illustration according to FIG. 10 without lines of intersection.

FIG. 13 shows the rotation device 300 without the packing table 11 and only partially illustrated rollers/drums 312.

Figure 7:
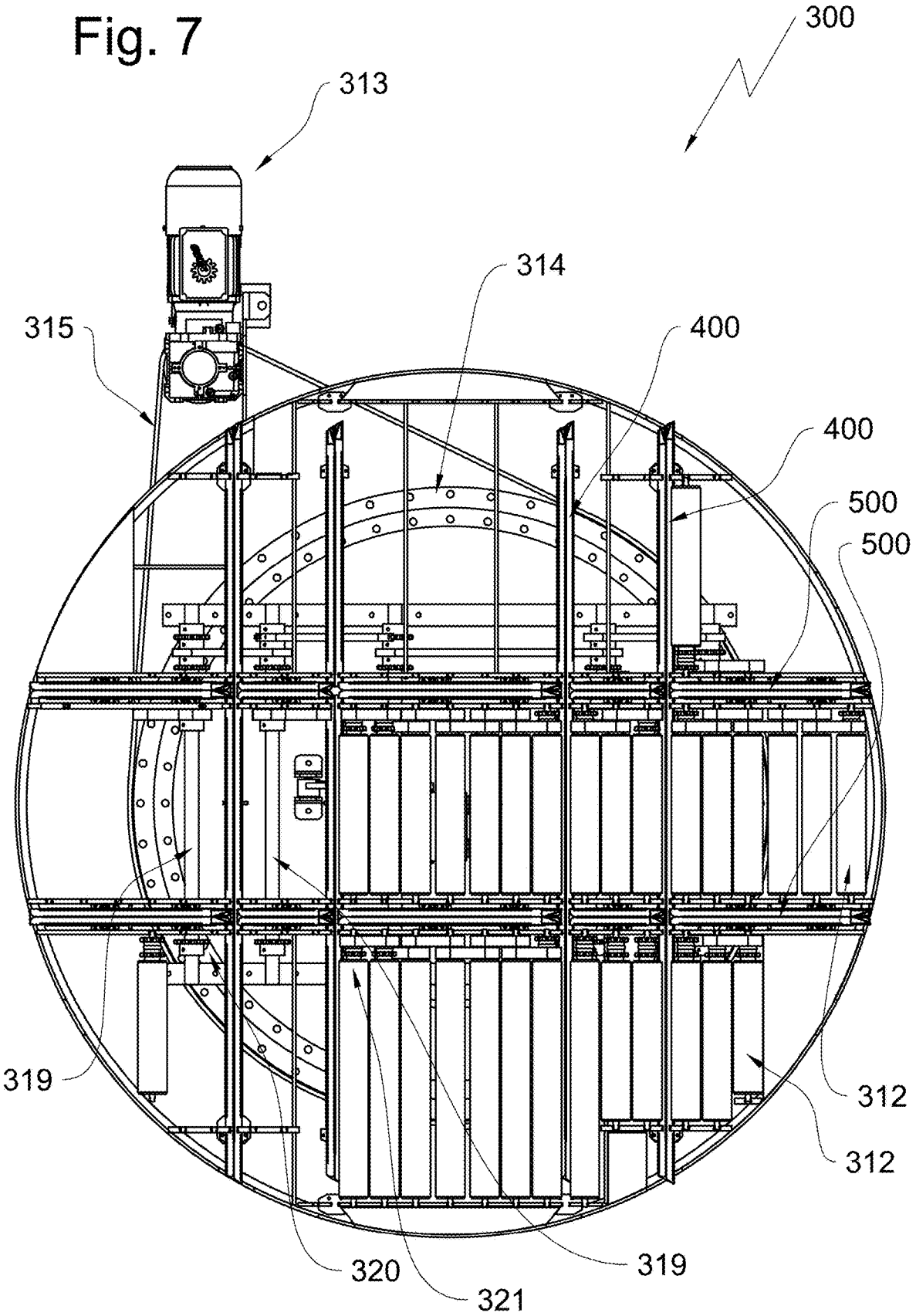
FIG. 7 is a view of the rotation device of the device according to FIG. 1 from above.

FIG. 7 shows that the intersecting member portions 400 and 500 which are connected to the rotation device divide the contact surface of the rotation device 300 for a package into individual fields, in which the rollers 312 are located. A rotary ring 314 (see also FIGS. 8 and 9) which is arranged under the package contact surface is connected via a drive belt 315 with drive disks 316 to a drive motor 313. The drive belt may be a toothed belt or a chain. By way of the drive belt 315, the drive motor 313 via the rotary ring 314 can drive the rotation device 300 about the rotation axis thereof which is not illustrated in greater detail through at least 90° in a counterclockwise direction and in a clockwise direction.

Figure 8:
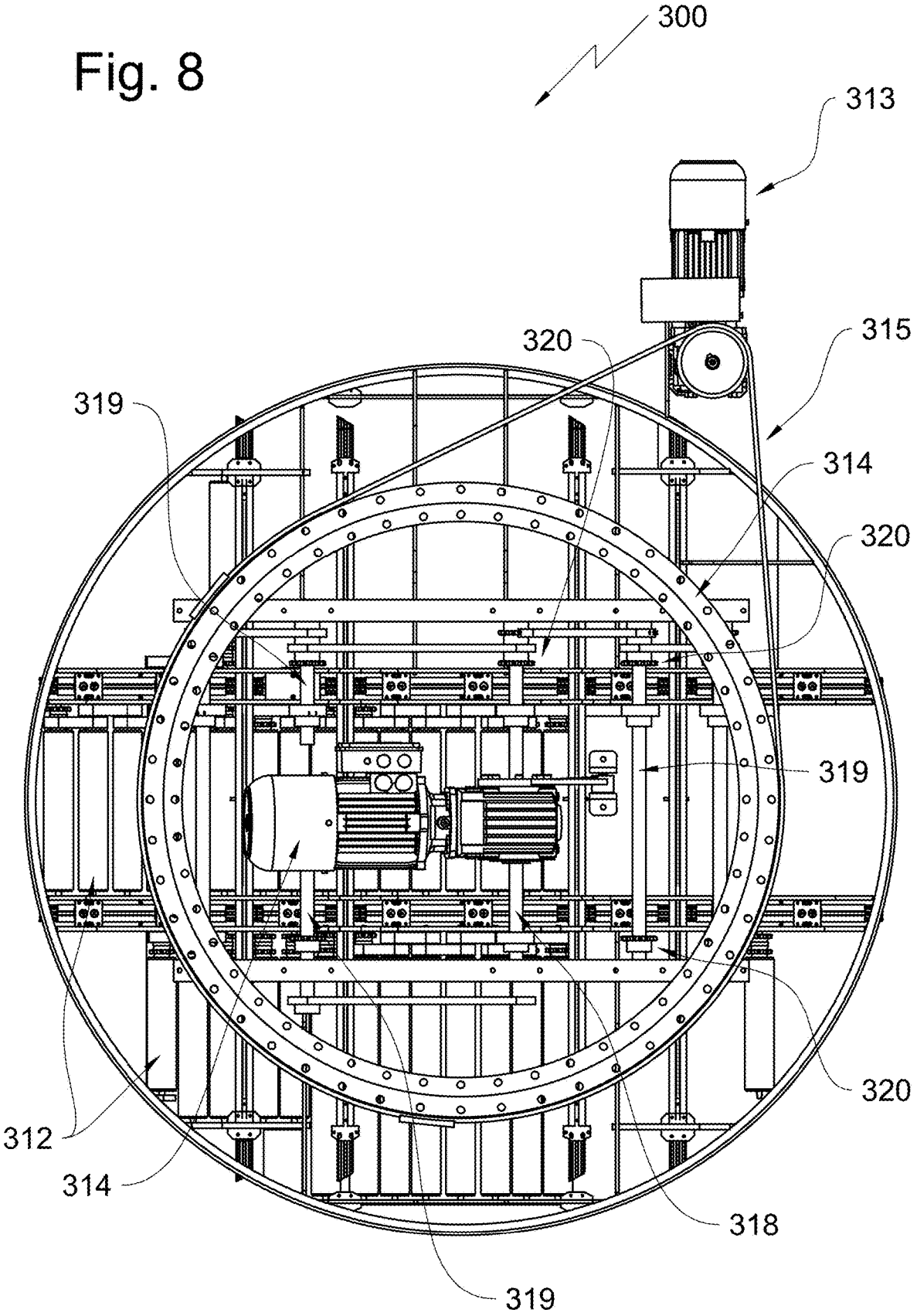
FIG. 8 is a view of the rotation device according to FIG. 7 from below.
Figure 9:
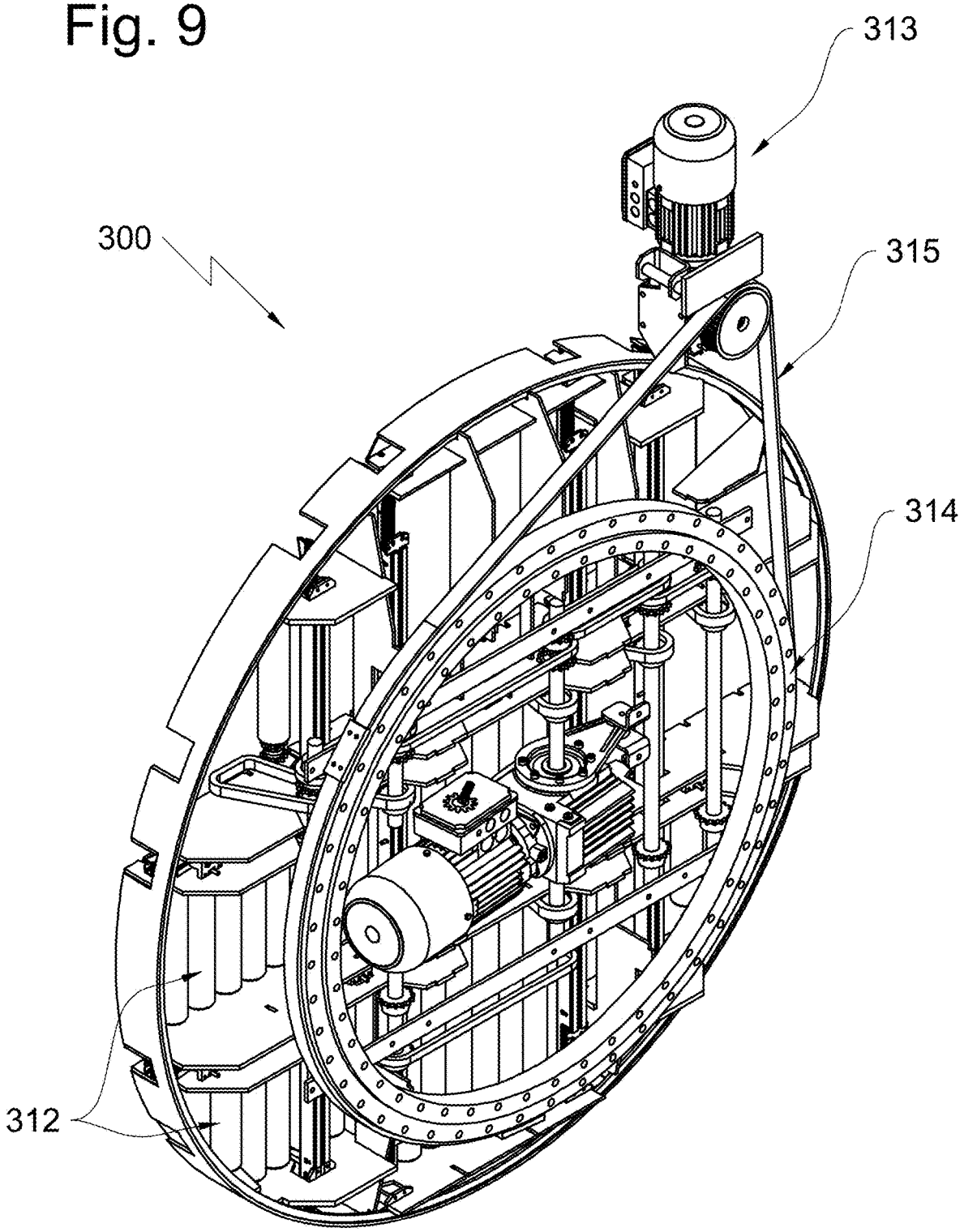
FIG. 9 is a perspective view of the lower side of the rotation device according to FIG. 7.

As shown in particular in FIGS. 8 and 9, at the lower side of the rotation device 300 a roller motor 317 is arranged inside the rotary ring 314. This motor drives a drive shaft 318, by way of which, via a system of follower shafts 319, the rollers 312 which are combined by the intersecting member portions 400 and 500 in individual fields to form groups can be driven. To this end, the drive shaft 318 and the follower shaft 319 carry toothed wheels 320 which by way of chains which are not illustrated transmit their rotational movement to roller toothed wheels 321 and consequently ultimately to the rollers 312 (see also FIG. 13).

The solution of the present disclosure to produce intersecting member portions 400 and 500 which are connected to the rotation device in the region of the rotation device in such a manner that the introduction of the strapping band and also the removal thereof from the member portions 400, 500 is possible without disruption will now be described below:

Each member portion 22 which is fixed in position in the non-movable packing table portion 13 has an outlet 23 which faces the rotation device 300 (see FIG. 4). These outlets 23 are all located in a common plane.

Figure 14:
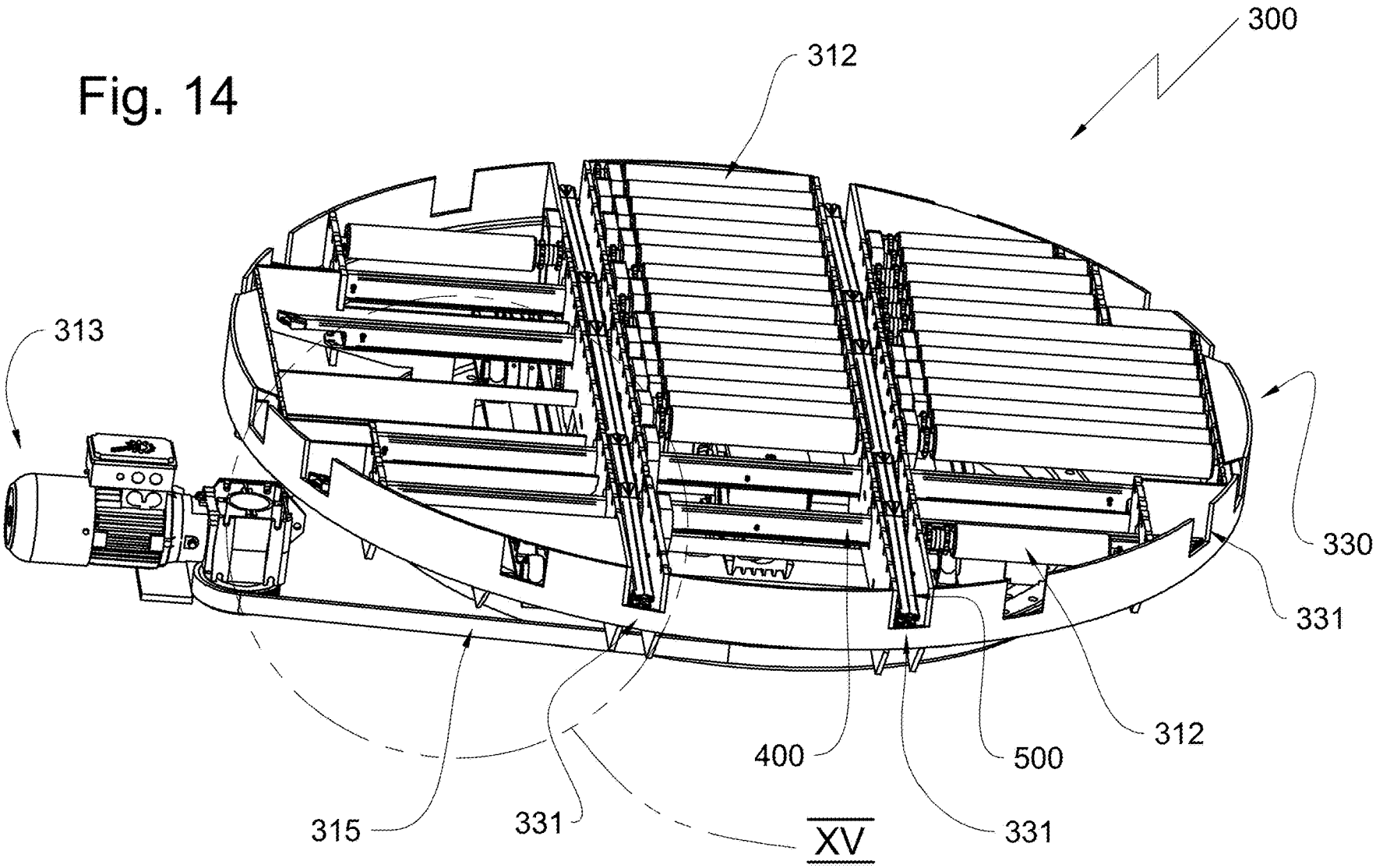
FIG. 14 is a perspective view of the upper side of the rotation device of the strapping device according to FIG. 1.
Figure 15:
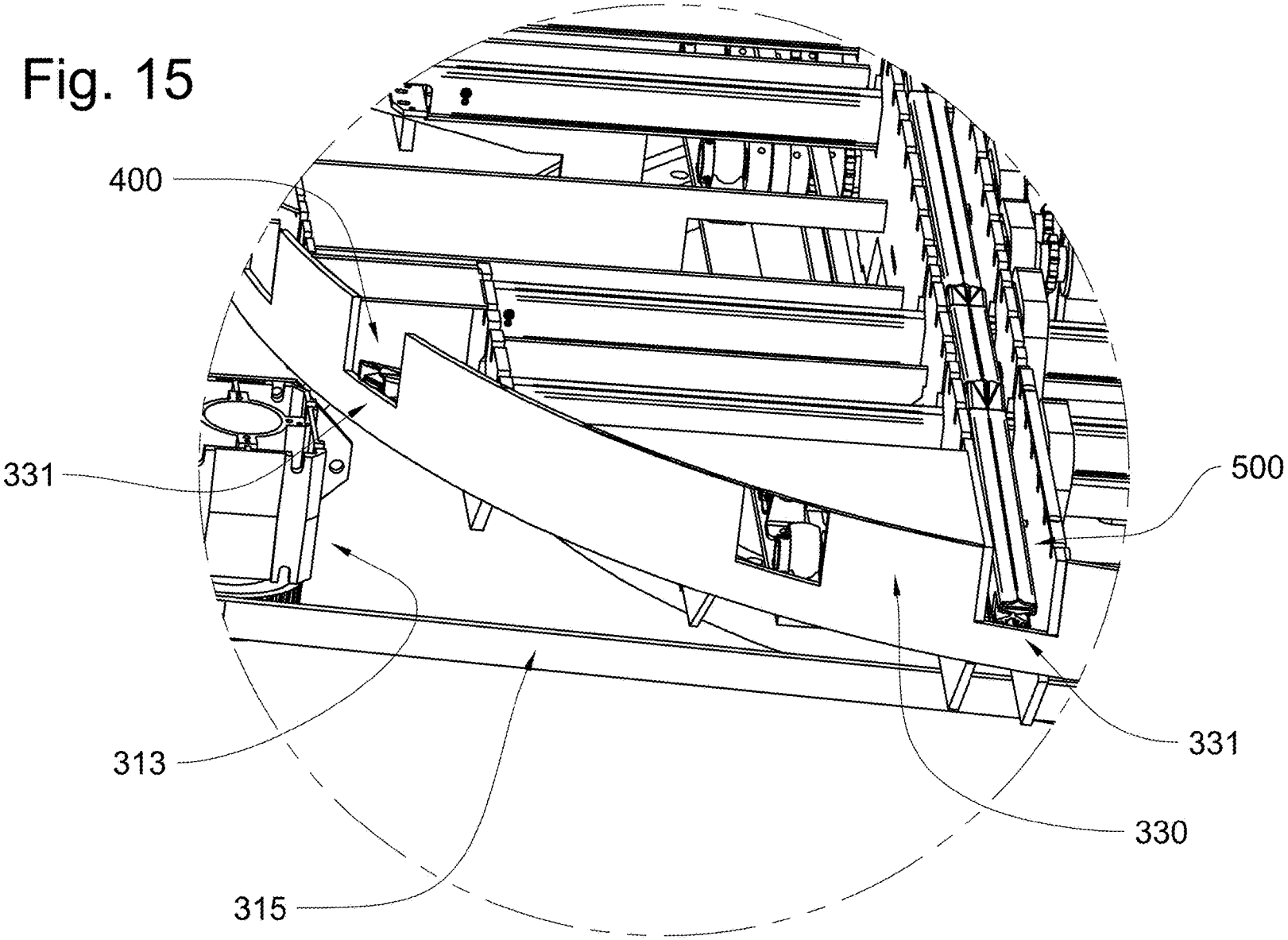
FIG. 15 is an enlarged cut-out according to the cut-out circle XV in FIG. 14.

FIGS. 14 and 15 now show the rotation device 300 without additional packing table components or an enlarged cut-out according to the cut-out circle XV in FIG. 14. The peripheral ring 330 which delimits the rotation device 300 has in the region of each end a member portion 400, 500 a recess 331, via which the respective member end of the member portions 400, 500 is accessible. The ends of the member portions 400, 500 which are connected to the rotation device, which ends are accessible in each case via the recesses 331 of the peripheral ring 330 of the rotation device 300, form inlets 410, 510. The inlets 410, 510 are also all located in a common plane which is not illustrated. The plane of the inlets 410, 510 is identical to the plane of the outlets 23 of the member portions 22 which are fixed in position.

It is thus possible to guide the strapping band B from an outlet 23 through the recess 331 of the peripheral ring 330 of the rotation device 300 to an inlet 410, 510. The strapping band B can on its way through the strapping channel 15 in the region of the packing table 11 or the channel member 16 thereof be moved initially into the member portion 22 which is fixed in position and then-depending on the orientation of the rotation device 300—via an inlet 410 or 510 through the respective member portion 400 or 500 which is connected to the rotation device and then into the second member portion 22 which is fixed in position. A continuous channel member 16 in the packing table is consequently provided in each position of the rotation device 300.

Figure 5:
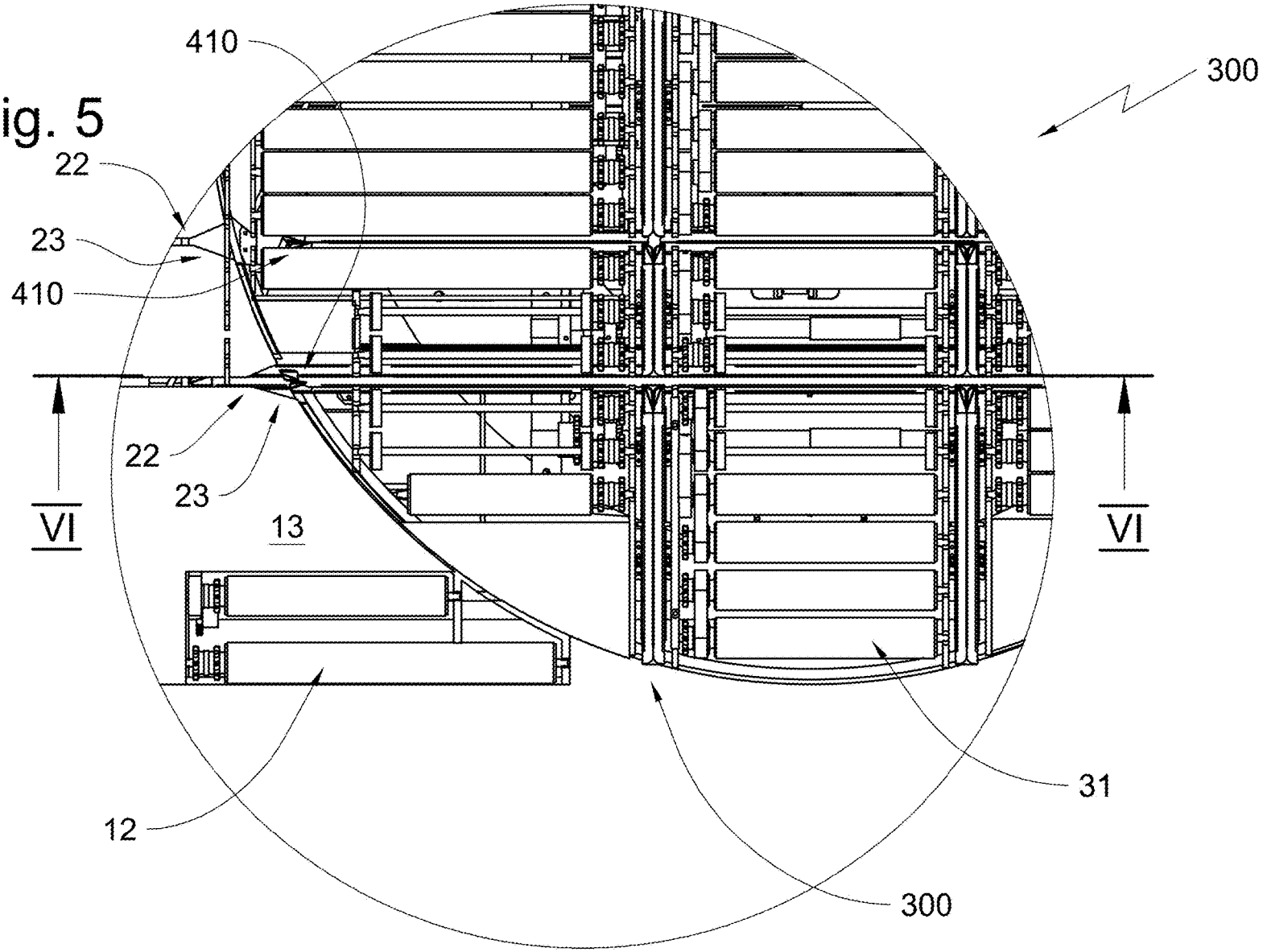
FIG. 5 is an enlarged cut-out according to the cut-out circle V in FIG. 4.

FIG. 5 shows an enlarged cut-out according to the cut-out circle V in FIG. 4. In this Figure, the transition region between a non-movable packing table portion 13 and the rotation device 300 is again illustrated to an enlarged scale. The outlets 23 of the member portions 22 of each channel member 16 which are fixed in position are arranged with respect to the inlets 410 of the member portions 400 which are orientated accordingly with the member portions 22 in this illustration.

Figure 6:
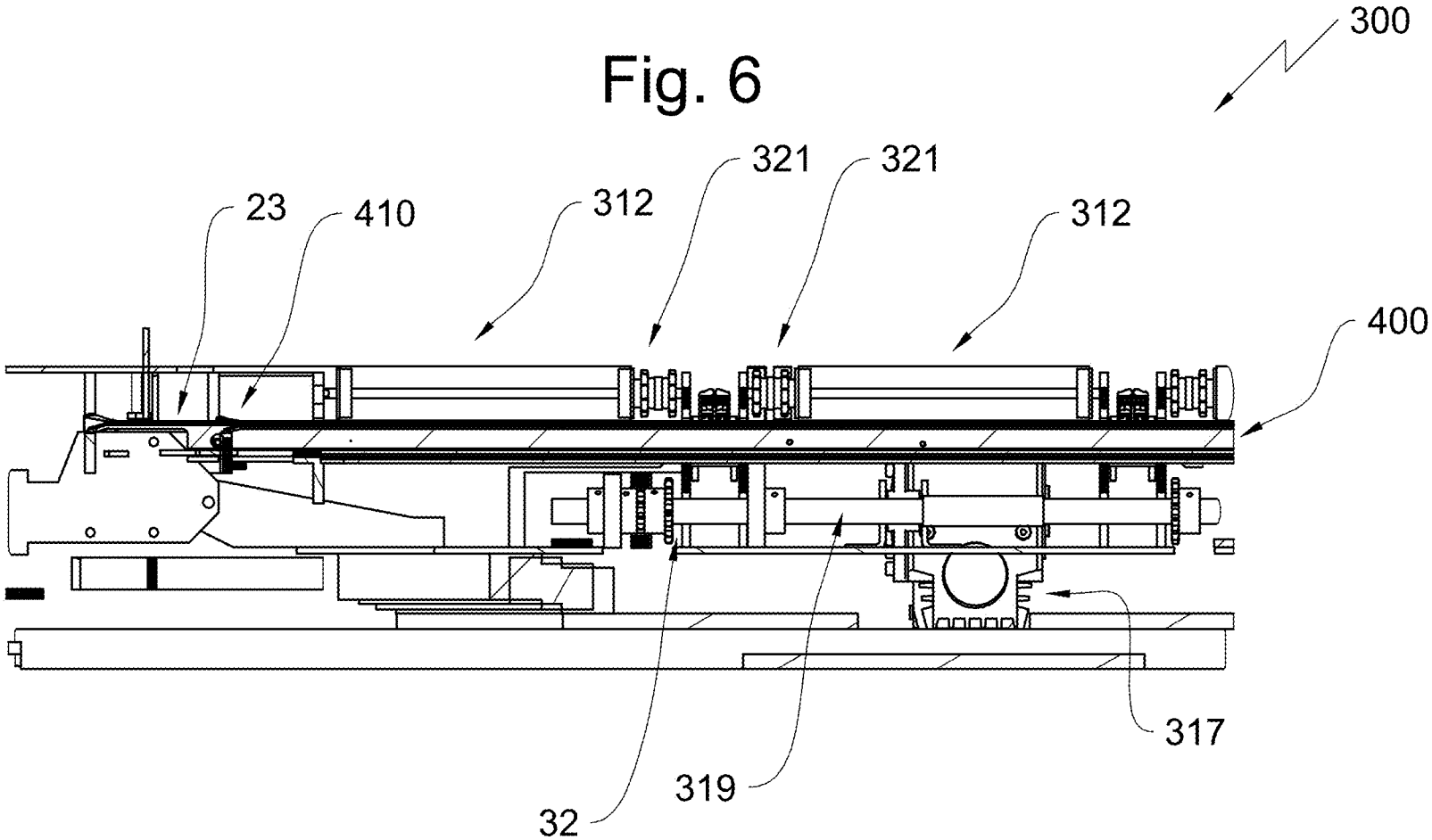
FIG. 6 is a vertical section through the packing table cut-out illustrated in FIG. 5.

FIG. 6 is a vertical section according to the line of section VI-VI in FIG. 5 through the member portion 400 which is connected to the rotation device. This illustration shows again that the outlets 23 are located in the same plane as the inlets 410.

Figure 10:
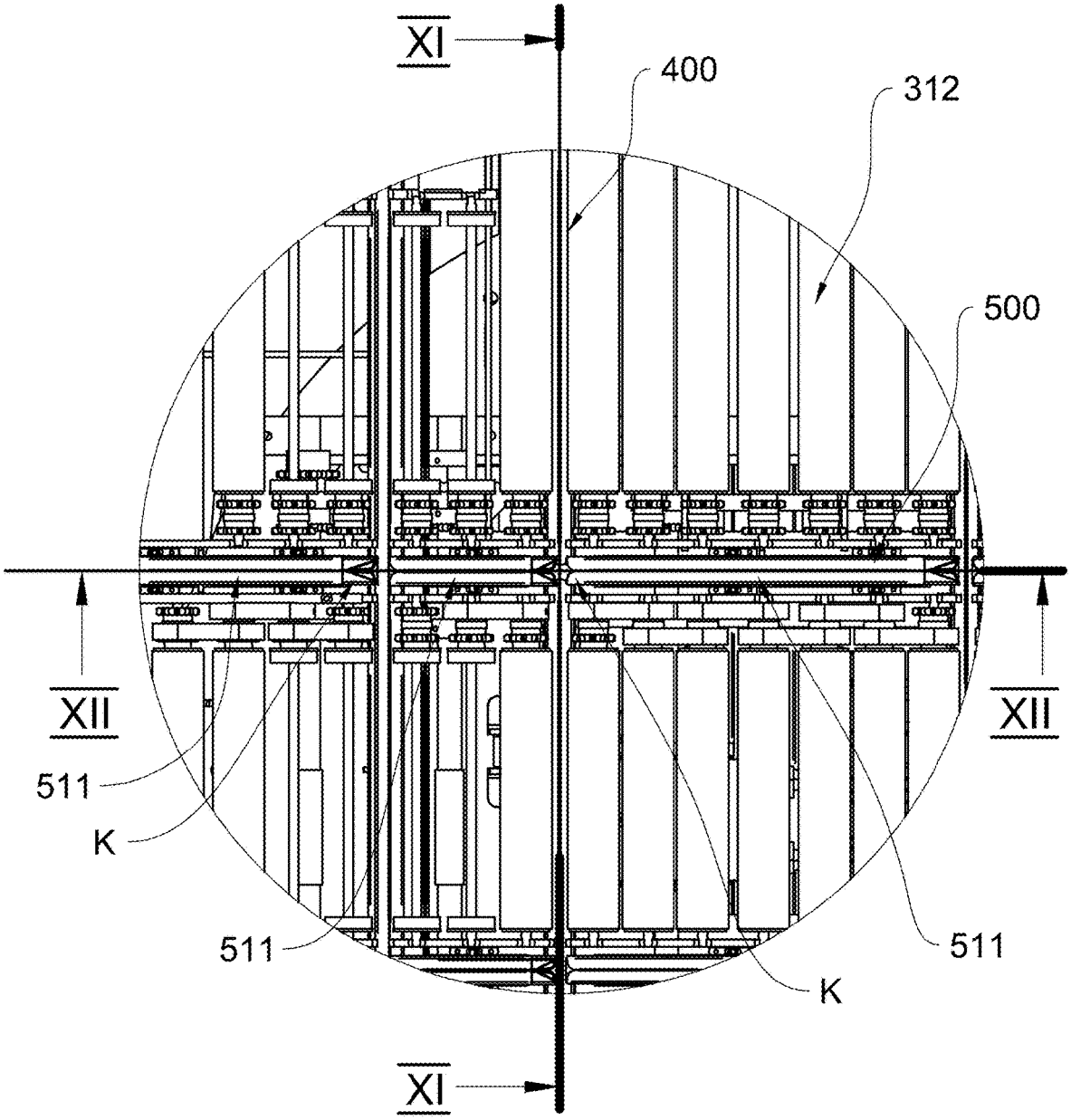
FIG. 10 is an enlarged cut-out according to the cut-out circle X in FIG. 4.

FIG. 10 is an enlarged cut-out of the rotation device according to the cut-out circle X in FIG. 4. The member portions 400 and 500 are again arranged between the rollers 312 at that location.

Figure 11:
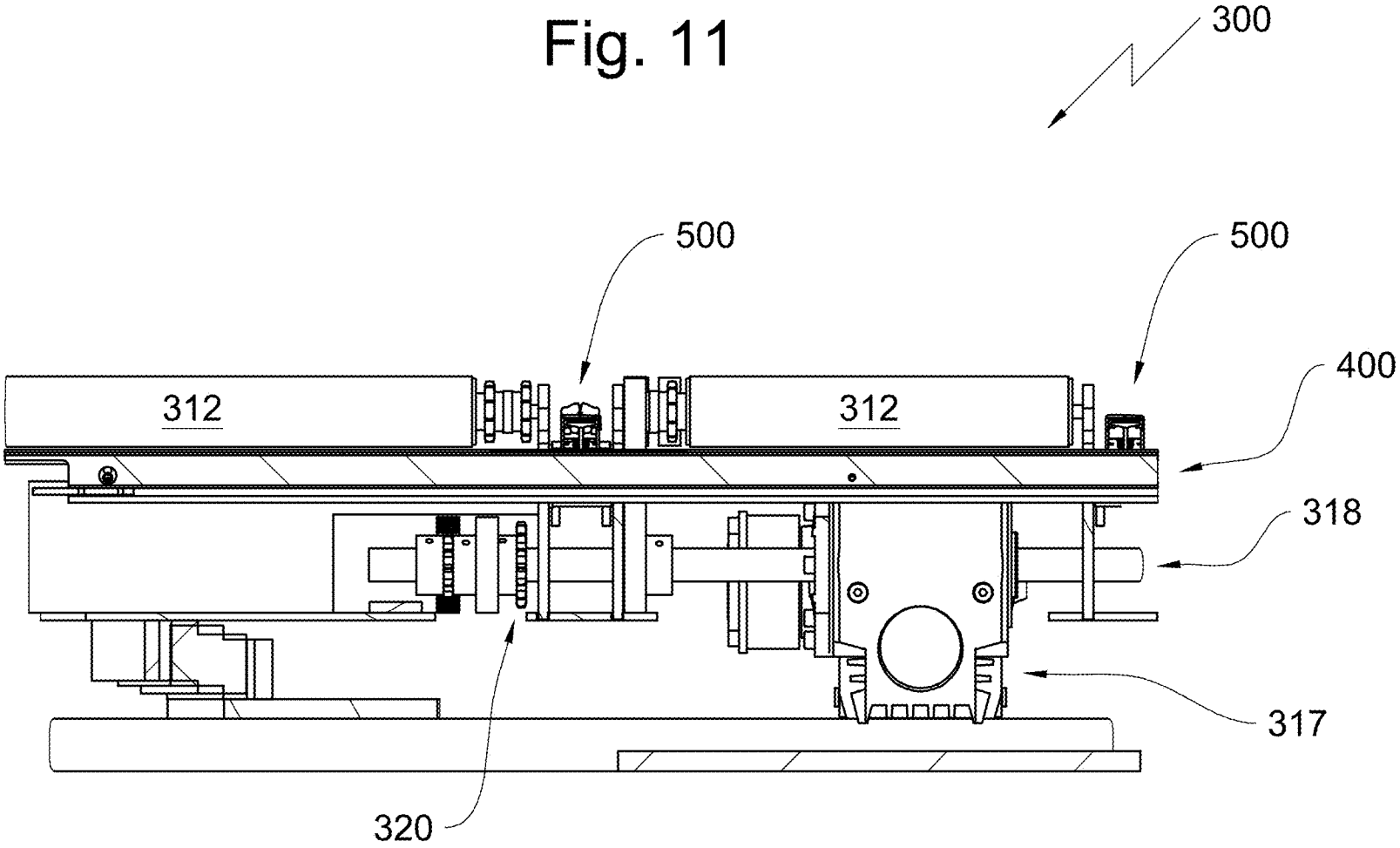
FIG. 11 is a sectioned illustration along the line of section XI-XI in FIG. 10.
Figure 12:
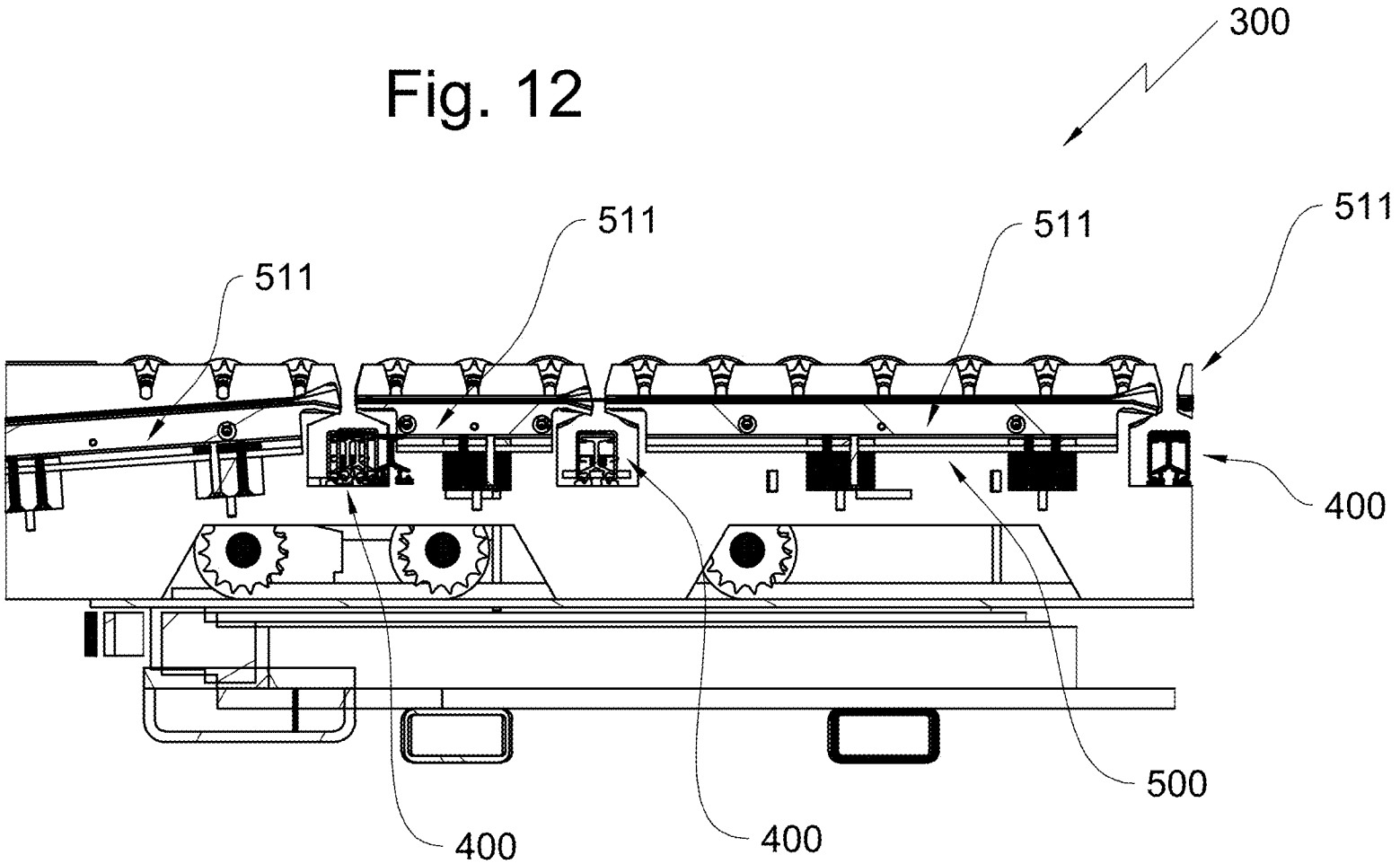
FIG. 12 is a sectioned illustration along the line of section XII-XII in FIG. 10.

FIG. 11 is a sectioned illustration along the line of section XI-XI in FIG. 10, FIG. 12 is a sectioned illustration along the line of section XII-XII in FIG. 10. Initially FIG. 11 shows that the member portion 400 which is parallel with the roller axis is located over the entire longitudinal extent thereof through the rotation device 300 in one and the same plane, that is to say, in the plane of the inlets 410, 510 and the outlets 23. This is also shown in FIG. 6. Furthermore, the member portion 400 which is connected to the rotation device, that is to say, the member portion 400 which is axially parallel with the rollers, extends through the rotation device 300 preferably in an integral manner. It is not sub-divided into individual segments.

As can be seen in FIG. 10 and FIG. 12, the second member portion 500 of the rotation device 300 which is orientated orthogonally with respect to the roller axes is constructed differently. It is sub-divided into individual member segments 511 which are separated from each other in the region K of intersecting member portions 400, 500. Between the individual member segments 511, in the regions K a spacing in the band passage direction of approximately a band width is provided. FIG. 12 further shows that the member portions 500 are arranged in a plane above the member portions 400. The member segment 511' which is close to the inlet rises from the common plane of the inlets 410/510 and 23 into the arrangement plane of the member portion 500. The member segment 511' which is close to the inlet consequently moves the incoming strapping band with a corresponding orientation with the respective outlet 23 from the common arrangement plane of the outlets 23 and inlets 410/510 into the arrangement plane of the member portion 500. The member portion 500 with the member segments 511 thereof consequently spans the member portions 400 which are connected to the rotation device in a substantially bridge-like manner.

Figure 16:
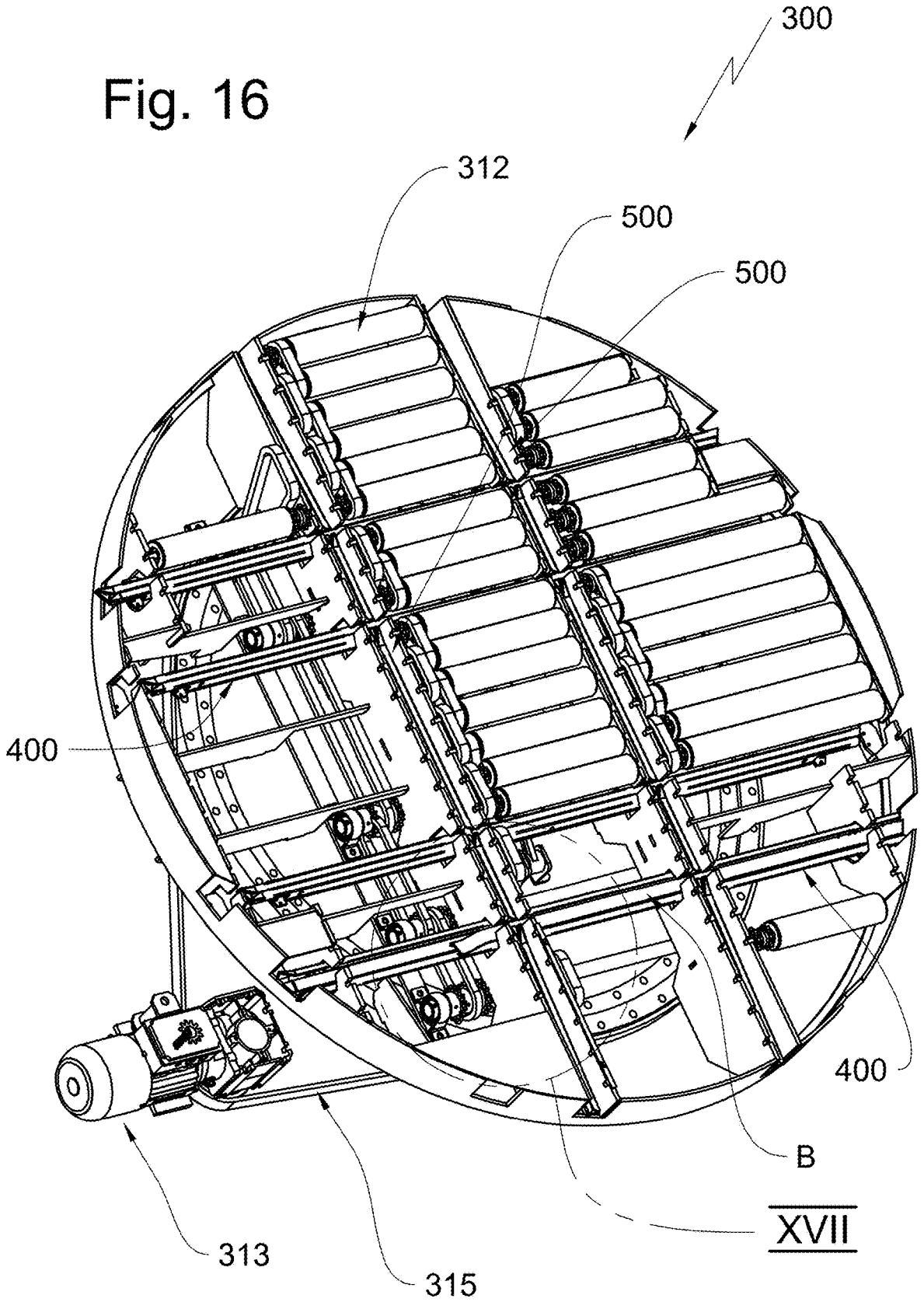
FIG. 16 is another perspective view of the rotation device of the strapping device according to FIG. 1, as a perspective view.
Figure 17:
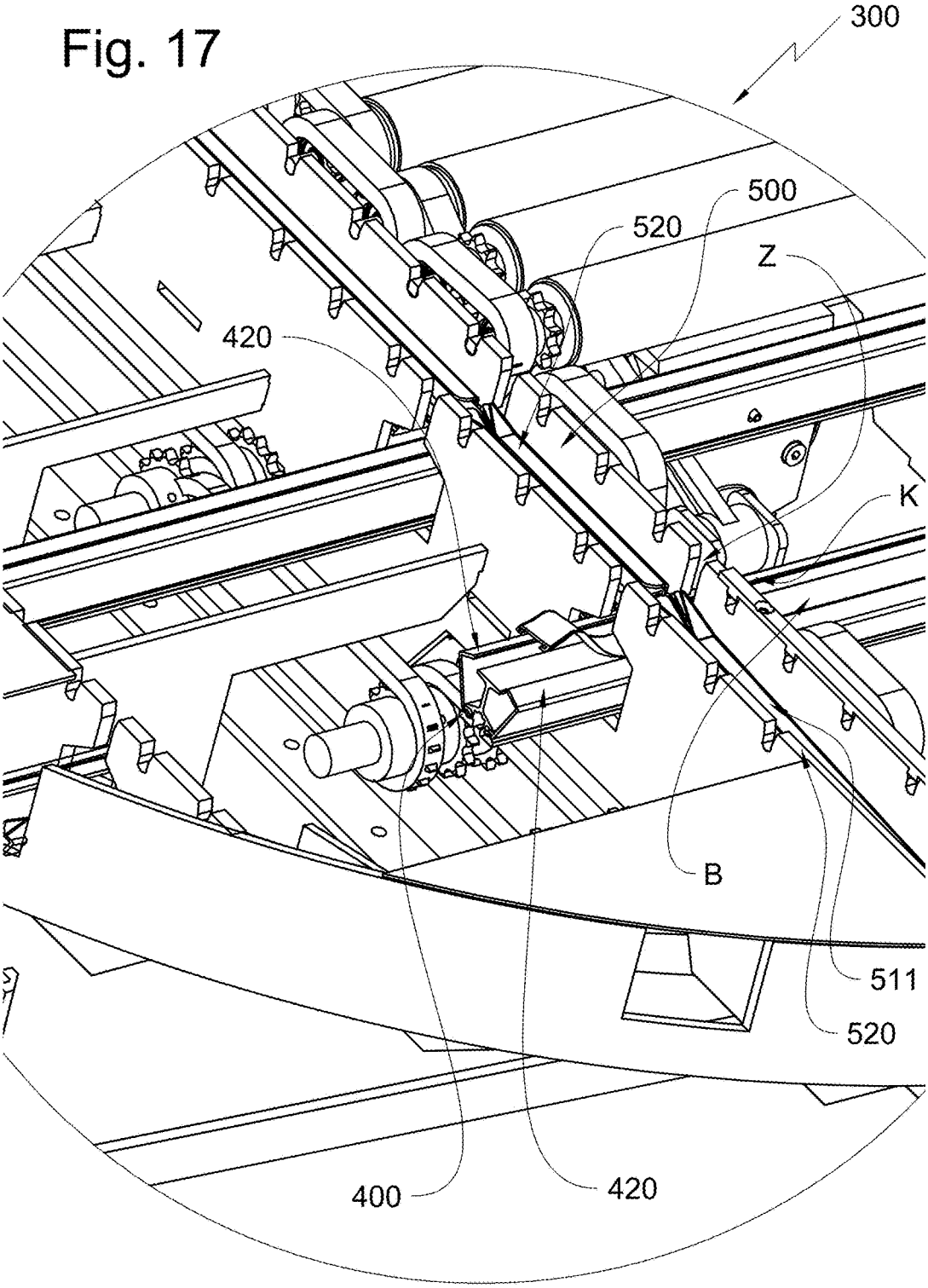
FIG. 17 is an enlarged cut-out according to the cut-out circle XVII in FIG. 16.

With reference to FIGS. 16 and 17, the strapping band removal from the member portion 400 is shown in an intersection region K with the member portion 500. As can also be seen in the remaining Figures, but is not designated therein, the member portions 400 have band channel flaps 420. In the same manner, the member portions 500 or the member segments 511 thereof also have band channel flaps 520. The respective band channel flaps close in the closed state the strapping channel or the respective member portions 400, 500 or segments 511 in the direction of the strapping frame interior. In this manner, it is ensured that the strapping band which is enclosed in the strapping channel 15 along the strapping frame is not discharged from the strapping channel 15.

When the strapping band is pulled back in order to tension the strapping band B around the package, the strapping B is pulled out of the strapping channel 15 with the resiliently loaded flaps 420 being opened. FIG. 17 shows the member portion 400 with open band channel flaps 420, from which the strapping B is discharged and is pulled through the intermediate space Z between the member segments 511 of the member portion 500. In FIG. 17, the member portion 400 has been cut away in order to clearly show the flap opening. The dual T-profile which is located between the band channel flaps 420 forms, on the one hand, the band channel base and, on the other hand, serves to retain the band channel flaps 420.

In FIG. 17, the intermediate space Z is smaller in terms of its width than the band width. However, this is only for the purposes of illustration in order to illustrate the strapping band in a sufficiently visible manner. In fact, the intermediate space Z may have at least a width which corresponds to the band width in order to prevent damage to the strapping band B when pulled out of the intermediate space Z.

LIST OF REFERENCE NUMERALS

10 Strapping device
11 Packing table
12 Roller/drum
13 Non-movable packing table portion
14 Pressing plate
Strapping channel
16 Horizontal channel member
17 Vertical channel member
18 Band feeding device
19 Supply bar connected to the rotation device
20 Reel
21 Insertion and closure device
22 Member portion of 16 which is fixed in position
23 Outlet of 22
300 Rotation device
312 Roller/drum
313 Drive motor
314 Rotary ring
315 Drive belt
316 Drive disk
317 Roller motor
318 Drive shaft
319 Follower shaft
320 Gear
321 Roller gear
330 Peripheral ring
331 Recess
400 Member portion which is connected to the rotation device
410 Inlet
420 Band channel flap
500 Member portion which is connected to the rotation device
510 Inlet
511 Member segment
520 Band channel flap
K Intersection region of 400 and 500
B Strapping/strapping band
Z Intermediate space

The invention claimed is:

1. A strapping device comprising:
an upper channel portion;
a first side channel portion;
a second side channel portion;
a packing table comprising:
a stationary first portion comprising a first lower channel portion,
a stationary second portion comprising a second lower channel portion, and
a rotatable portion positioned between the first stationary portion and the second stationary portion and comprising a third lower channel portion and a fourth lower channel portion that extends transversely to the third lower channel portion, wherein the third lower channel portion is positioned in a first plane, wherein part of the fourth lower channel portion is positioned in a second plane above the first plane, wherein the rotatable portion is configured to rotate between:
(i) a first strapping position in which the third lower channel portion extends between the first lower channel portion and the second lower channel portion such that the upper channel portion, the first side channel portion, the second side channel portion, the first lower channel portion, the second lower channel portion, and the third lower channel portion define a first strap channel, and
(ii) a different second strapping position in which the fourth lower channel portion extends between the first lower channel portion and the second lower channel portion such that the upper channel portion, the first side channel portion, the second side channel portion, the first lower channel portion, the second lower channel portion, and the fourth lower channel portion define a second strap channel; and
a feeding device configured to: (a) when the rotatable portion is in the first strapping position, feed strap from a supply into and around the first strap channel; and (b) when the rotatable portion is in the second strapping position, feed the strap from the supply into and around the second strap channel.

2. The strapping device of claim 1, wherein the rotatable portion comprises a rotatably supported circular region of the packing table.

3. The strapping device of claim 1, wherein the rotatable portion is configured to rotate 90° from the first strapping position to the second strapping position.

4. The strapping device of claim 1, wherein the rotatable portion comprises a plurality of rollers having substantially parallel rotational axes, wherein the third lower channel portion extends substantially parallel to the rotational axes of the rollers, and wherein the fourth lower channel portion extends transversely to the rotational axes of the rollers.

5. The strapping device of claim 1, wherein the third lower channel portion and the fourth lower channel portion each comprise flaps movable from a closed state to an open state to enable strap removal.

6. The strapping device of claim 1, wherein the third lower channel portion and the fourth lower channel portion are perpendicular.

7. The strapping device of claim 1, further comprising a drive motor operably connected to the rotatable portion and configured to rotate the rotatable portion between the first strapping position and the second strapping position.

8. The strapping device of claim 1, wherein the first lower channel portion defines a strap outlet adjacent to the rotatable portion.

9. The strapping device of claim 8, wherein the third lower channel portion defines a first strap inlet, wherein the fourth lower channel portion defines a second strap inlet, wherein the first strap inlet is adjacent the strap outlet when the rotatable portion is in the first strapping position, wherein the second strap inlet is adjacent the strap outlet when the rotatable portion is in the second strapping position.

10. The strapping device of claim 9, wherein the fourth lower channel portion comprises individual first, second, and third segments.

11. The strapping device of claim 10, wherein the first segment defines the second strap inlet.

12. The strapping device of claim 11, wherein the third lower channel portion, the strap outlet, the first strap inlet, and the second strap inlet are positioned in the first plane.

13. The strapping device of claim 12, wherein the second segment is positioned in the second plane, wherein the first segment is inclined.

14. The strapping device of claim 13, wherein a gap is defined between the first segment and the second segment, wherein the third lower channel portion is positioned below the gap.

15. The strapping device of claim 14, wherein the rotatable portion comprises a plurality of rollers having substantially parallel rotational axes, wherein the third lower channel portion extends substantially parallel to the rotational axes of the rollers, and wherein the fourth lower channel portion extends transversely to the rotational axes of the rollers.

16. The strapping device of claim 15, wherein the third lower channel portion and the fourth lower channel portion are perpendicular.

17. The strapping device of claim 15, wherein the third lower channel portion and the fourth lower channel portion each comprise flaps movable from a closed state to an open state to enable strap removal.

18. The strapping device of claim 1, further comprising a second upper channel portion, a third side channel portion substantially parallel to the first side channel portion, and a fourth side channel portion substantially parallel to the second side channel portion, wherein:

the upper channel portion comprises a first upper channel portion and is substantially parallel to the second upper channel portion, the stationary first portion further comprises a fifth lower channel portion substantially parallel to the first lower channel portion, the stationary second portion further comprises a sixth lower channel portion substantially parallel to the second lower channel portion, the rotatable portion further comprises a seventh lower channel portion substantially parallel to the third lower channel portion and an eighth lower channel portion transverse to the seventh lower channel portion and substantially parallel to the fourth lower channel portion, when the rotatable portion is in the first strapping position, the seventh lower channel portion extends between the fifth lower channel portion and the sixth lower channel portion such that the second upper channel portion, the third side channel portion, the fourth side channel portion, the fifth lower channel portion, the sixth lower channel portion, and the seventh lower channel portion define a third strap channel, and when the rotatable portion is in the second strapping position, in which the eighth lower channel portion extends between the fifth lower channel portion and the sixth lower channel portion such that the second upper channel portion, the third side channel portion, the fourth side channel portion, the fifth lower channel portion, the sixth lower channel portion, and the eighth lower channel portion define a fourth strap channel.

19. The strapping device of claim 18, further comprising a second feeding device configured to: (a) when the rotatable portion is in the first strapping position, feed a second strap from a second supply into and around the third strap channel; and (b) when the rotatable portion is in the second strapping position, feed the second strap from the second supply into and around the fourth strap channel.

* * * * *